US009549579B2

(12) United States Patent
Bailey

(10) Patent No.: US 9,549,579 B2
(45) Date of Patent: Jan. 24, 2017

(54) GRIPPING GLOVE

(71) Applicant: Claiborne Bailey, Addy, WA (US)

(72) Inventor: Claiborne Bailey, Addy, WA (US)

( * ) Notice: Subject to any disclaimer, the term of this patent is extended or adjusted under 35 U.S.C. 154(b) by 0 days.

(21) Appl. No.: 14/701,311

(22) Filed: Apr. 30, 2015

(65) Prior Publication Data

US 2015/0313298 A1 Nov. 5, 2015

Related U.S. Application Data

(60) Provisional application No. 61/986,965, filed on May 1, 2014.

(51) Int. Cl.
*A41D 19/015* (2006.01)
*A63B 71/14* (2006.01)

(52) U.S. Cl.
CPC ..... *A41D 19/01564* (2013.01); *A63B 71/143* (2013.01); *A63B 71/146* (2013.01); *A63B 71/148* (2013.01); *A63B 60/54* (2015.10); *A63B 2209/00* (2013.01)

(58) Field of Classification Search
CPC ..... A61B 19/04; A63B 71/148; A63B 71/146; A41D 19/02; A41D 13/08
USPC ..... 2/168, 161.1, 161.3, 160, 169, 16, 20
See application file for complete search history.

(56) References Cited

U.S. PATENT DOCUMENTS 3,175,226 A 3/1965 Weinberg
3,413,000 A * 11/1968 Alkonis ..... A41D 19/01547 2/161.6
4,561,122 A 12/1985 Stanley et al.
5,168,578 A * 12/1992 Stanley ..... A63B 71/143 2/19
5,257,418 A * 11/1993 Jaskiewicz ..... A41D 19/01523 2/161.1
5,345,609 A 9/1994 Fabry et al.
5,604,934 A * 2/1997 Willett ..... A41D 19/01547 2/161.1
5,790,980 A 8/1998 Yewer, Jr.
5,806,091 A * 9/1998 McHugh ..... A41D 13/082 2/161.1
5,987,642 A 11/1999 Webster
6,260,198 B1 * 7/2001 LoMedico ..... A41D 13/081 2/161.1
6,427,246 B1 8/2002 Doi et al.
6,721,960 B1 4/2004 Levesque et al.
7,895,669 B2 3/2011 Kleinert
7,963,864 B2 6/2011 Frost

* cited by examiner

*Primary Examiner* — Tejash Patel
(74) *Attorney, Agent, or Firm* — Lee & Hayes, PLLC

(57) ABSTRACT

This disclosure describes a gripping glove with a gripping aid to increase the grip span of a user. In some implementations, the gripping aid may be composed of a crush resistant, flexible material and further include a crest or fulcrum to increase the speed, strength and/or torque of each swing of a tool (e.g., a baseball bat, sledge hammer, or the like). In some implementations, the gripping aid may also provide a reduction in vibrations and superficial hand traumas normally caused when the tool strikes an object.

20 Claims, 13 Drawing Sheets

GRIPPING GLOVE

CROSS REFERENCE TO RELATED APPLICATION

This application claims priority under 35 U.S.C §119 to U.S. Provisional Patent Appln. No. 61/986,965 filed May 1, 2014, entitled "Improved Gripping Glove," the entirety of which is incorporated by reference in its entirety.

BACKGROUND

Human hands are used to accomplish many tasks and therefore are susceptible to vibration, bone bruises, blisters, fatigue, and/or other discomfort. This is particularly true when a user must grip and manipulate a tool with a handle (e.g., ax, hammer, shovel, baseball/softball bat, lacrosse stick, rowing oar, or the like). In these instances, because of the lack of support within the thumb web area of the hand, the user must exert maximum gripping effort with their hand(s) to properly control the tool. However, such maximum gripping effort may result in various injuries to the hand such as blisters and/or bruises caused by vibrations transferred to the hand when the tool contacts an object (tree, nail, ball, or the like). Furthermore, the generally round diameter of tool handles for multiple tool applications does not provide an ideal shape for maximizing grip span and/or user comfort. In addition, round handle shapes do not provide the ideal leverage point needed for maximizing the efficiency, control, power, speed, and/or strength of a user manipulating the tool. As such, there remains a need for a comfortable gripping glove that provides ergonomically placed support for comfort and minimizes potential damage to a user's hand(s) by reducing vibrations, bone bruises, blisters and fatigue, while simultaneously providing a fulcrum to maximize the efficiency, control, power, speed, and/or strength as the user manipulates the tool.

BRIEF SUMMARY OF INVENTION

This disclosure generally relates to a glove for the human hand which may be worn to improve a user's grip on an item. In some implementations, this disclosure describes an improved gripping glove as it relates to a swingable tool with a rigid handle (i.e., cylindrical, elliptic cylinder, polyhedral cylinder with n-gonal sides, or the like) such as a hammer, ax, shovel, baseball bat, softball bat, golf club, oar, paddle, or the like. Furthermore, this disclosure relates to a gripping aid which may act as a shaped support along a portion of the thumb webbing on the palmar side of a hand that may enhance biomechanical functions and capabilities of the user's hand while gripping. In some implementations, the gripping aid integrated with the glove may be a continuous piece of material from a joint on a first digit (e.g., thumb) of a hand to a joint on a second digit (e.g., index finger) of the hand. In some implementations, the gripping aid may act as a shaped support which may be a crush resistant compound such a silicon rubber, ethylene propylene rubber, or the like. In some implementations, the shaped support may provide a buffer zone to help position the tool away from a portion of the hand. In this instance, the gripping aid may reduce or eliminate the rotational forces upon the hand as the tool is manipulated and, ultimately, reduce or eliminate the incidence of superficial skin trauma (e.g., abrasions and/or blisters) to the hand.

Furthermore, this disclosure describes a gripping aid that places the hand in the optimal gripping position by increasing the grip span, which enhances grip strength. Additionally, in some implementations, this disclosure describes the gripping aid which may also include a crest (i.e., pivot ridge, crown, or fulcrum) that allows the hand to more efficiently and effectively manipulate the tool as it is swung. For instance, the crest may act to speed the centripetal force of a distal end of tool as the user grips and swings a proximal end of the tool. In some implementations, the crest shape of the gripping aid may increase momentum or torque of the tool as it is swung and thus lower the moment of inertia without reducing the power created by the swing. In this instance, the gripping aid may help maximize the efficiency and/or speed of each swing of the tool. As such, the gripping aid described herein may increase output forces upon the tool, enhance comfort, reduce grip tension, reduce vibration, and reduce overall fatigue of a user swinging the tool. In other implementations, the gripping aid described herein may be used independently of other aids or as an integral part of other gripping aids, for example gloves.

BRIEF DESCRIPTION OF THE DRAWINGS

The detailed description is set forth with reference to the accompanying figures. In the figures, the left-most digit(s) of a reference number identifies the figure in which the reference number first appears. The use of the same reference numbers in different figures indicates similar or identical items or features.

DETAILED DESCRIPTION

Figure 1:
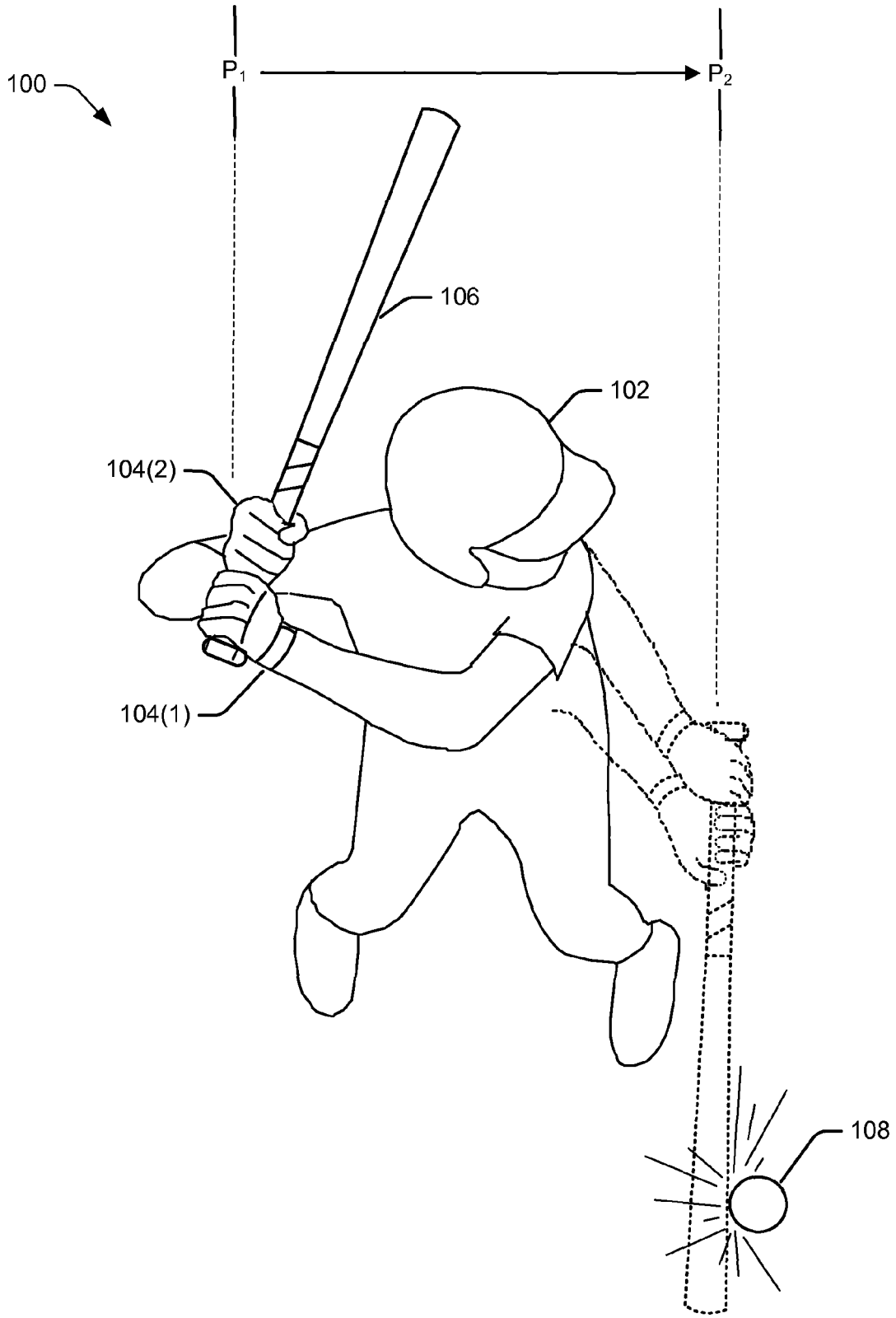
FIG. 1 is an example environment for a user of the gripping glove.

This disclosure describes embodiments of a glove with a gripping aid or support for providing maximum grip control, force, torque, acceleration, rotation, and/or leverage without requiring a user to provide maximum grip or squeezing effort. Furthermore, the glove with the gripping aid may further reduce incidences of superficial skin trauma (e.g., abrasions and/or blisters) caused by the rotational forces associated with a swing and/or reduce vibrations caused when the tool strikes an object.

In some implementations, the gripping aid may be incorporated within a portion of a glove. For instance, the gripping aid may be a single shaped support that extends continuously between the distal interphalangeal (DIP) joint or the proximal interphalangeal (PIP) joint of the index finger and the interphalangeal (IP) joint of the thumb along the thumb webbing/thenar webbing which is the "skin web" that extends between the thumb and index finger. In some implementations, the gripping aid is more specifically offset toward the lateral aspect of the area between a joint on the index finger and a joint on the thumb. In this implementation, each joint of the index finger and each joint of the thumb may be permitted to flex without significant impediment from the gripping aid.

The gripping aid may be formed or molded from a crush resistant, vibration dampening, flexible material such as silicone rubber, ethylene propylene rubber, or other elastomers. In some implementations, the hardness of the gripping aid may be from about 10 to about 90 using a Shore A durometer. In addition, the gripping aid may be resistant to crushing deformation such that the overall thickness of the gripping aid may be maintained even when a user is securely gripping the tool and is applying a squeezing force to the gripping aid. In this implementation, the gripping aid may generally fill the gap between the handle of the tool and the thumb webbing of the user and provide a support to transfer an oppositional force between the user's hand and the tool at the thumb webbing.

In some implementations, the gripping aid may be pre-contoured to fit the thumb webbing of a user's hand and/or include a hinge (e.g., parametric kerf pattern, living hinge, lattice hinge, zipper joint, or rib joint) to maximize the flexibility of the gripping aid. Furthermore, the thickness and/or shape of the gripping aid may vary. For instance, the thickness of the gripping aid may taper as the gripping aid approaches a joint of the index finger and/or thumb. In some implementations, a side of the gripping aid toward a user may include a contoured or concaved surface to better conform to the finger(s), thumb, and thumb webbing of the user.

In other implementations, the glove may include more than one gripping aid or shaped support. For instance, in one implementation, a first, more soft or supple, support may be located between the user's hand(s) and attached to a second, more resilient support configured to interface with the tool. In other implementations, a glove may include more than one gripping aid in more than one location of the palmar side of the glove. In these implementations, the hardness of the multiple gripping aids may be in a range of about 0 as measured using a Shore A durometer to about 90 using a Shore D durometer.

A thickness of the gripping aid may position the hand in the optimal gripping span for optimal gripping strength. In some implementations, the shape of the gripping aid may also concentrate gripping pressure about and along a top surface of the gripping aid while the gripping aid's resistance to crushing causes an upper crest/crown portion of the gripping aid to function as a fulcrum about which the gripped portion (i.e., handle) of the tool pivots during a swing.

The concentrated gripping pressure or tension may lead to decreased user hand fatigue, increased comfort, and increased control for the specific task using the handled tool. Furthermore, the specific placement of the gripping aid may allow unrestricted motion of the fingers and hand joints by keeping the support away from the center axis of rotation for each specific joint, thereby creating momentum.

In some implementations, the gripping aid may have different sizes and shapes while maintaining a domed or apical shape with a crest/crown and thicknesses, depending on the size of the user's hand and/or the application of the tool. For instance, the thickness of the gripping aid may be about 1 millimeter to about 25.5 millimeters. In some implementations, the thickness of the gripping aid may be at least 0.5 millimeter. In some implementations, the thickness of the gripping aid may be from about 6 millimeters to about from 12 millimeters. In other implementations, the thickness of the gripping aid may be from about 0.5 millimeters to about from 5 millimeters.

Furthermore, the gripping glove may be constructed in any number of sizes to fit the hands (left and/or right) of various users. For instance, a smaller glove with a smaller gripping aid may be constructed for use by a younger user with a smaller hand(s). Conversely, a larger glove with a larger gripping aid spanning an area to substantially cover the thumb webbing of a larger hand(s) may be constructed for an older user.

The term "about" or "approximate" as used in context of describing example gripping gloves is to be construed to include a reasonable margin of error that would be acceptable and/or known in the art.

As used herein, the terms "a," "an," and "the" mean one or more.

As used herein, the terms "comprising," "comprises," and "comprise" are open-ended transition terms used to transition from a subject recited before the term to one or more elements recited after the term, where the element or elements listed after the transition term are not necessarily the only elements that make up the subject.

As used herein, the terms "having," "has," "contain," "including," "includes," "include," and "have" have the same open-ended meaning as "comprising," "comprises," and "comprise" provided above.

The present description may use numerical ranges to quantify certain parameters relating to the invention. It should be understood that when numerical ranges are provided, such ranges are to be construed as providing literal support for claim limitations that only recite the lower value of the range as well as claim limitations that only recite the upper value of the range. For example, a disclosed numerical range of 1 to 10 provides literal support for a claim reciting "greater than 1" (with no upper bounds) and a claim reciting "less than 10" (with no lower bounds) and provides literal support for and includes the end points of 1 and 10.

This overview is provided to introduce a selection of concepts in a simplified form that are further described below. The overview is provided for the reader's convenience and is not intended to limit the scope of the claims, nor the proceeding sections.

Example Environment

FIG. 1 illustrates an example environment 100 for the use of the gripping glove. FIG. 1 shows a user 102, such as a batter, wearing gripping gloves 104(1) and 104(2) on a left and right hand, respectively. As shown, the user 102 is also holding a bat 106 at a position $P_1$ corresponding to a set, ready position prior to starting a swing. In other implementations, depending on the user preference and/or application of the gripping glove, the user 102 may wear a glove on only one hand.

In initiating a typical swing of the bat 106 (shown at $P_1$), the user 102 manipulates his/her body by rotating his/her hips, spine, shoulders, and arms to move the hands toward the object intended to be struck (e.g., baseball 108). Such rotation generates significant centripetal force at the distal end of the bat 106 (i.e., the bat head). Generally, the amount of force generated during this rotation will be translated into a power at the contact point of the baseball 108 (shown at $P_2$).

While not specifically shown in FIG. 1, the gloves 104(1) and 104(2) include the gripping aid as described above. In some implementations, the gripping aid includes the crest, pivot ridge, or fulcrum continuously running between the proximal interphalangeal (PIP) joint of the index finger and the interphalangeal (IP) joint of the thumb along the thumb webbing. In some implementations, the gripping aid and the crest may allow for a freedom of motion of the bat 106 over the apex of the crest. In some implementations, at or near portion $P_2$, the crest may allow for the bat 106 to move more quickly as the bat fulcrums over the apex of the crest while the user 102 swings the bat 106. This may result in increased centripetal force at the head of bat 106 which may result in an increase in power transfer to baseball 108 (and thus more exit speed of the baseball off the bat 106) without requiring the user 102 to significantly alter his/her grip strength, grip position, and/or swing speed.

In some implementations, the gripping aid within gloves 104(1) and 104(2) may reduce the vibrations caused when the bat 106 makes contact with baseball 108. Generally, the force of the baseball 108 striking the bat 106 will cause mechanical oscillation or vibrations in the material of the bat. Such vibrations may travel down the shaft of the bat and into the hands of the user 102. As mentioned above, the thickness of the crush resistant, vibration dampening, flexible material of the gipping aid may absorb and/or deflect a portion of the vibrations before they reach the palm of the user 102.

While FIG. 1 does not illustrate the specific features of the gripping glove, it is to be understood that the gripping gloves 104(1) and 104(2) may also provide the additional features such as, for example, increased comfort, skin trauma reduction, and/or increased grip span as described above and below.

Example Gripping Glove

Figure 2:
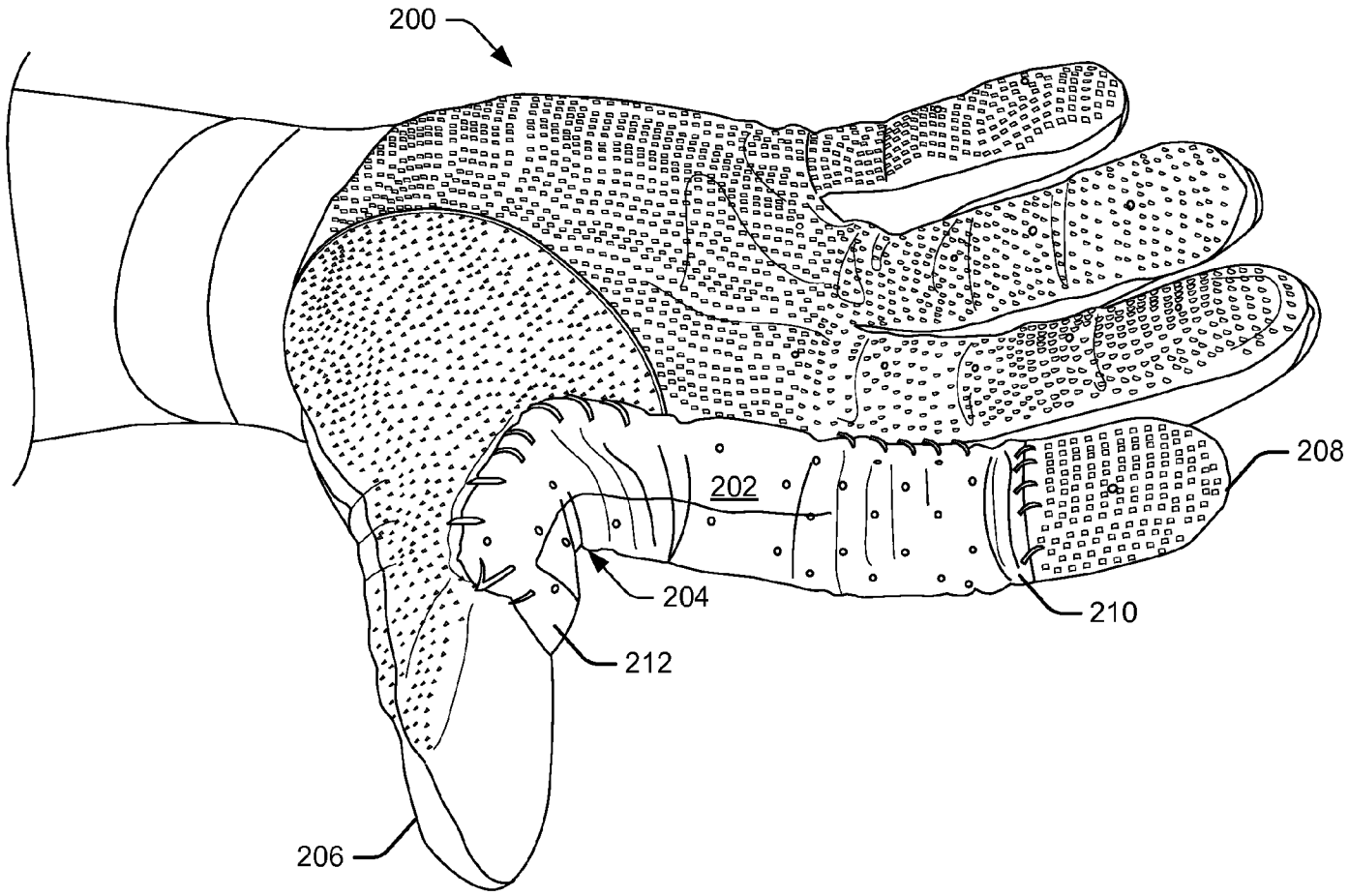
FIG. 2 is an example of a gripping glove with a gripping aid positioned over the lateral aspect of the human hand.

FIGS. 2-13 illustrate example embodiments or example components of a gripping glove. FIG. 2 illustrates an example embodiment of the gripping glove (hereinafter, "glove") 200. As shown, glove 200 is placed on a right hand of a human. However, in other embodiments, the glove 200 (or any other glove described herein) may be configured to be placed on a left hand of a human.

FIG. 2 illustrates that a gripping aid 202 may be place along the thumb webbing 204 between the thumb 206 and index finger 208. As shown, the gripping aid 202 may form a continuous support along the thumb webbing 204 from a first end 210 beginning on the index finger 208 at the distal interphalangeal (DIP) joint to the second end 212 on the thumb at the interphalangeal (IP) joint of the thumb. In other implementations, the first end 210 may begin at the proximal interphalangeal (PIP) joint of the index finger 208.

As shown, the gripping aid may be secured to the glove 200 by placing one or more pieces of fabric over the gripping aid 202. In some implementations, the fabric may be leather, synthetic leather, or any other natural or synthetic material which may be integrated with glove 200. FIG. 1 shows that the periphery of the fabric is sewn directly to glove 200. However, in other implementations, the fabric may be integrated with glove 200 by other methods (e.g., glue, sonic welding, etc). Additionally or alternatively, the gripping aid 202 may attached directly to the glove 200 without the fabric. In these implementations, gripping aid 202 may be glued, sewn, or otherwise bonded directly to the glove 200.

While FIG. 2 illustrates the gripping aid 202 positioned along the thumb webbing between the index finger and the thumb, it is to be understood that the gripping aid may be placed between any other joint on other fingers.

Figure 3:
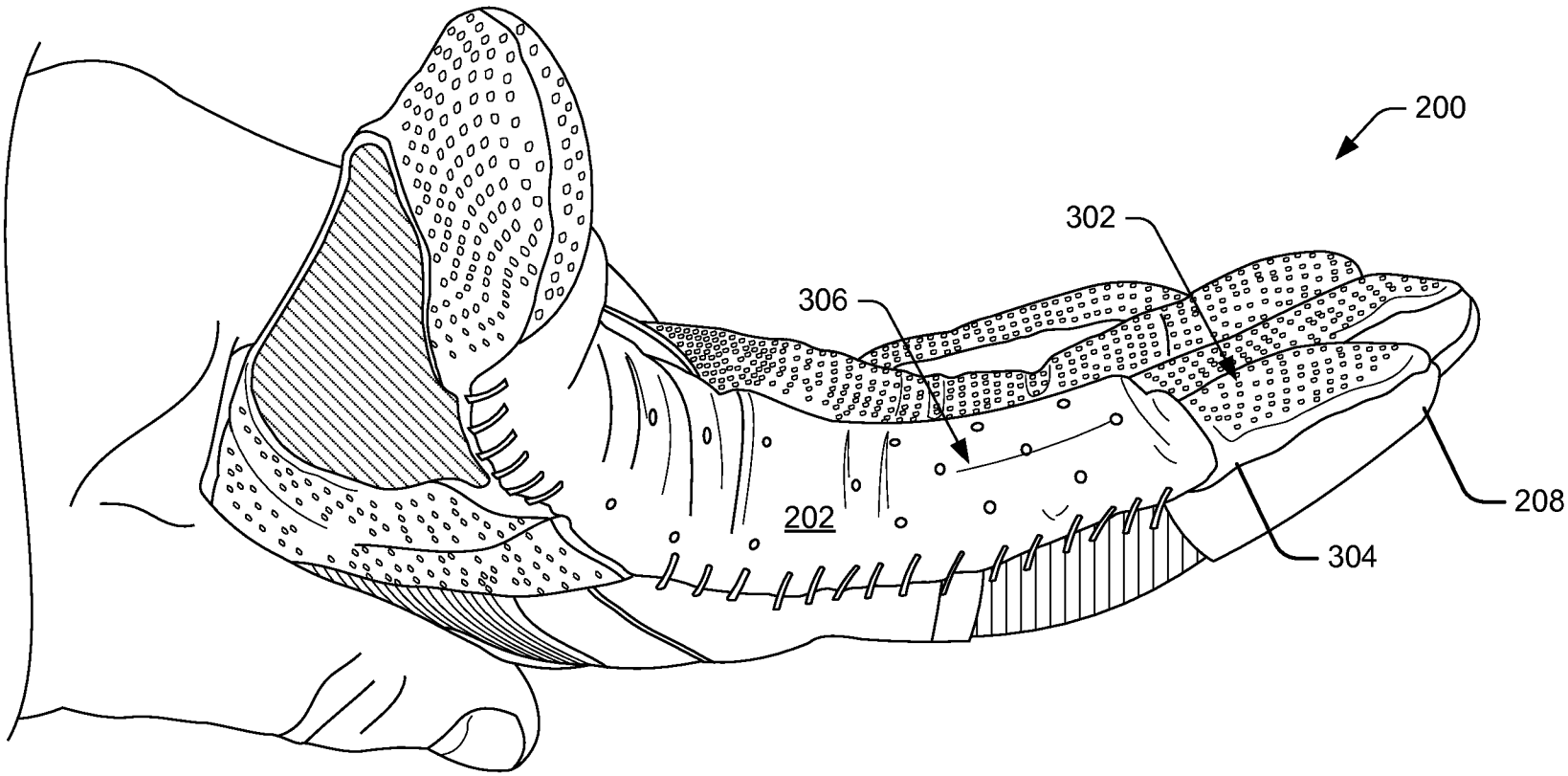
FIG. 3 is a side view of the example gripping glove of FIG. 2 in a neutral hand position.

FIG. 3 shows the gripping aid 202 which may be offset toward the lateral aspect of the thumb webbing between a joint on the index finger and a joint on the thumb. For instance, the gripping aid 202 may be affixed to the glove 200 from about 30 degrees to about 60 degrees from a medial surface 302 of the index finger 208 toward the lateral surface 304 of the index finger 208. In other implementations, the gripping aid may be equidistance from the medial surface 302 of the index finger 208 toward the lateral surface 304 of the index finger 208.

In some implementations, the lateral offset may reduce an amount of restriction of flexibility of each joint adjacent to the gripping aid when, for example, the index finger 208 of glove 200 is curled toward the palm of glove 200 as shown below in FIG. 5. In addition, the lateral offset may position a crest 306 (which is shown running a substantial portion of the apex of the gripping aid 202) in a position to maximize a speed of a handled tool as it is swung by a user wearing the glove 200.

The lateral offset of the gripping aid 202 as shown in FIG. 3 may also increase the grip span of a user wearing glove 200. That is, the thickness of the gripping aid extending toward the lateral aspect may increase the gripping surface of the user's hand which may allow the hand of the user to cover more surface of the gripping handle of a tool. One skilled in the art is generally aware of the positive correlation between an increase in grip span and an increase in grip strength. Thus, the glove 200 with the gripping aid 202 which increases the grip span of one or more user's hand may increase the user's grip strength without altering the user's existing grip and/or requiring a tighter grip.

Figure 4:
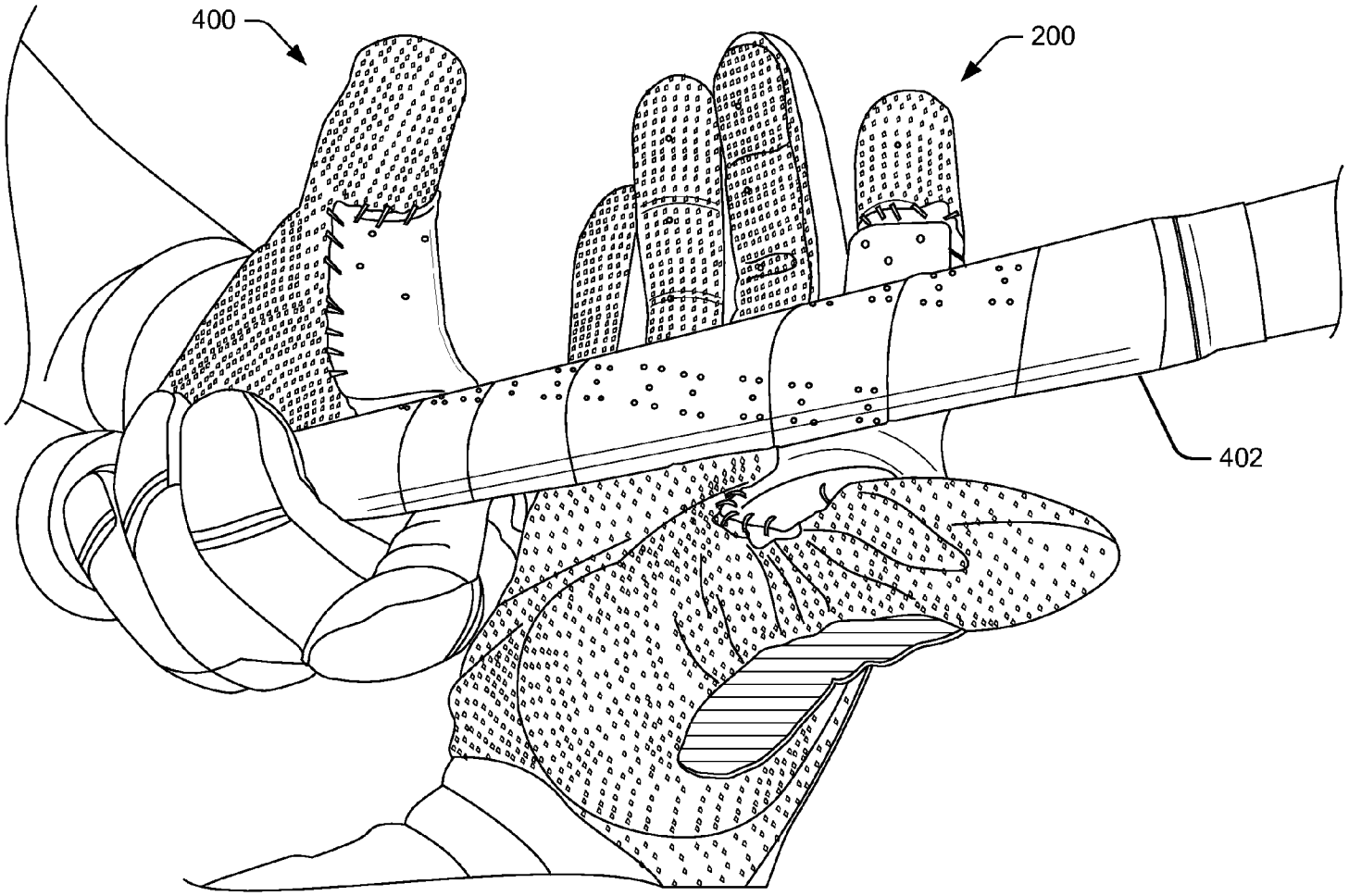
FIG. 4 is a perspective view of example gripping gloves, both having a gripping aid.

FIG. 4 illustrates right-handed glove 200 as described above in addition to a left-handed glove 400 (collectively hereinafter, "gloves"). As shown, the gloves are in the initial stages of gripping a handle of a tool—in this instance, a handle portion of a baseball bat 402. The handle portion of the baseball bat 402 (or any other handled tool) is configured to abut or rest in the thumb webbing of each hand wearing the gloves. Next, in some implementations, the each finger of the glove would wrap around the handle portion of the baseball bat 402.

Figure 5:
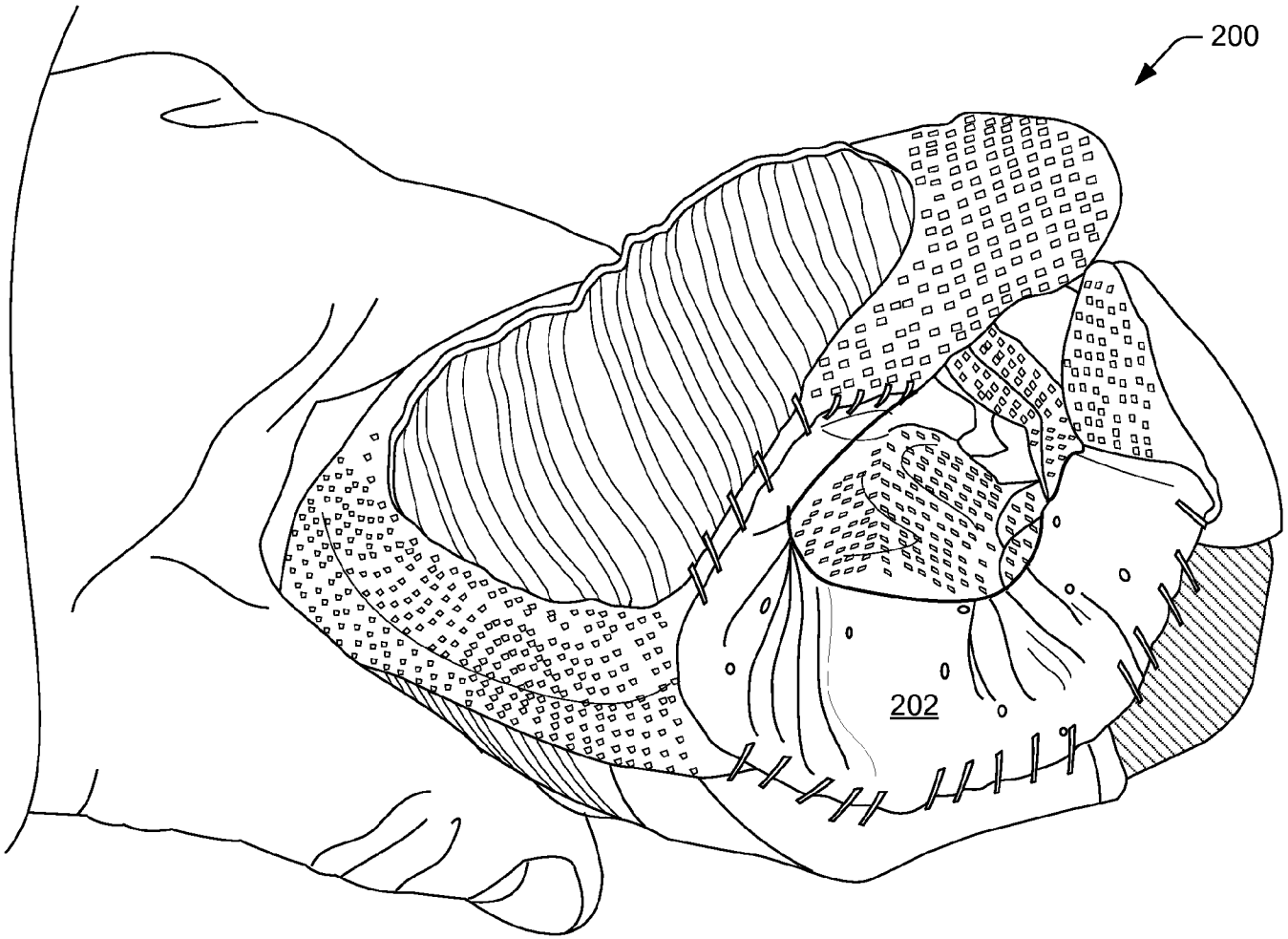
FIG. 5 is a side view of the example gripping glove of FIG. 2 in the flexed position.

As shown in FIG. 5, the gripping aid 202 integrated with the glove 200 may be configured to bend when the user wraps each finger around the handle portion of the baseball bat. In some implementations, the gripping aid 202 in glove 200 may be constructed of a flexible material such as silicone rubber, ethylene propylene rubber, or other elastomers. The gripping aid 202 may be a constructed to a thickness from about 1 millimeter to 25.5 millimeters such that the gripping aid 202 remains pliable along the gripping aid's longer axis while resisting crushing or deformation along the gripping aid's shorter axis.

In some implementations as illustrated below in FIGS. 12 and 13, the gripping aid 202 may be jointed and/or hinged to help the gripping aid flex along the longer axis. For instance, the gripping aid 202 may include a parametric kerf pattern, a living hinge, a lattice hinge, a zipper joint, a rib joint, or a combination thereof. In some implementations, the gripping aid 202 may be pre-contour before the gripping aid is integrated with glove 200 and depending on the size of glove 200. For instance, the gripping aid 200 may be molded or formed to fit the thumb webbing from a joint on the index finger to a joint on the thumb along of a particular size hand at a resting position (such as the hand position shown in FIG. 1 or 2). In other implementations, the gripping aid may be unmolded to contour to a user's hand or may be molded to contour to other positions of the user's hand (e.g., molded to fit a particular handle diameter as it would be gripped by a user's hands).

Figure 6:
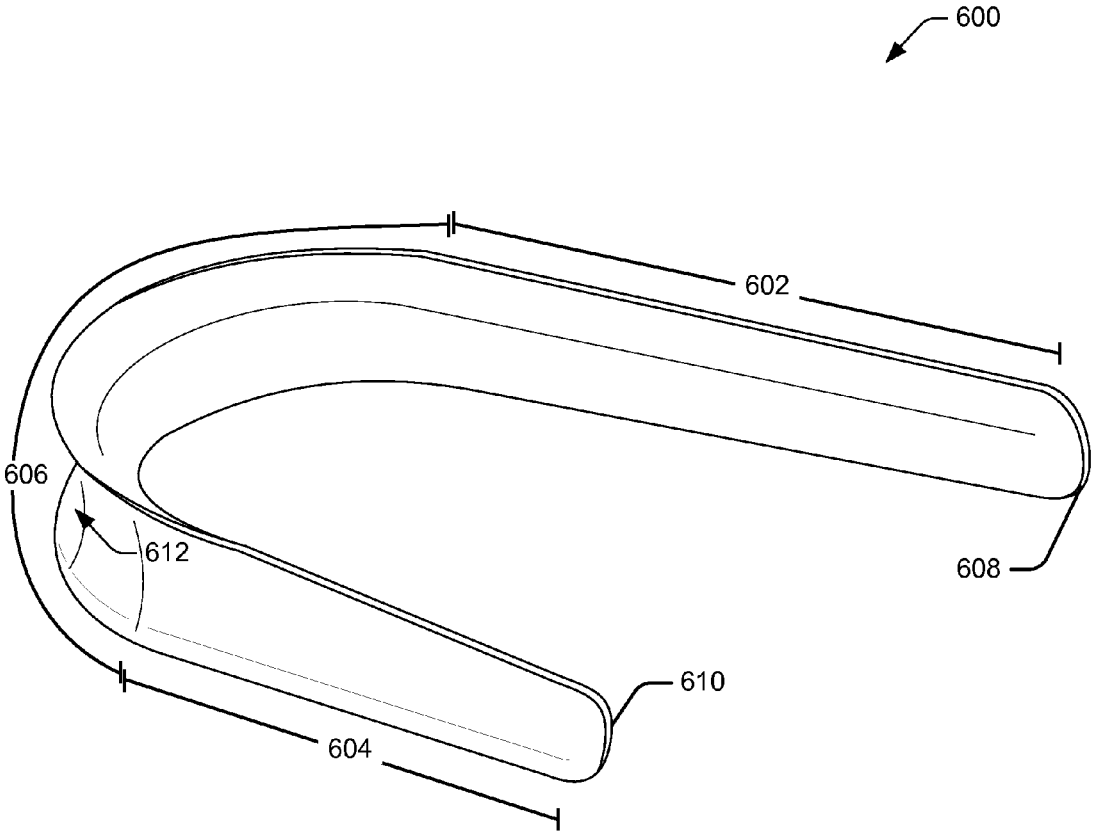
FIG. 6 is a perspective view of an example gripping aid with a concave surface.

FIG. 6 illustrates an example perspective view of a gripping aid 600 which may be integrated with a glove as described above. In some implementations, gripping aid 600 may be integrated on an exterior portion of a glove. However, in other implementations, gripping aid 600 may be integrated on an interior portion of the glove proximate to the glove wearer's skin. As described above, gripping aid 600 may be composed of a flexible elastomer such as silicone rubber, ethylene propylene rubber, for example. Furthermore, the gripping aid 600 may be configured to conform to a surface of a user's hand. As shown in FIG. 6, a first portion 602 may be configured to substantially cover a surface of a user's hand between the proximal interphalangeal (PIP) joint and the metacarpophalangeal (MCP) joint of the index finger. While a second portion 604 may be configured to cover to a surface of a user's hand between the interphalangeal (IP) joint and the metacarpophalangeal (MCP) joint of the thumb. Finally, in the implementation shown in FIG. 6, a third portion 606 may be configured to substantially cover the thumb webbing while the user wears the glove with the gripping aid 600.

Gripping aid 600 may be flexible such that when the user places the glove on his/her hand, the gripping aid 600 generally conforms to the contour of the user's hand. Furthermore, the flexibility of the gripping aid 600 may permit the first end 608 on the index finger and the second end 610 on the thumb to curve towards one another as the user grips the handle of a tool.

In some implementations, the thickness of gripping aid 600 may be uniform or the same from the first end 608 to the second end 610. However, in other implementations, the thickness of the gripping aid 600 may be less at the first end 608 and the second end 610. In this implementation, the thickness of the gripping aid 600 may gradually increase from each end toward the third portion 606 covering the thumb webbing.

As shown in FIG. 6, the gripping aid 600 may be configured to contour to the portion of the user's hand. For instance, the gripping aid 600 may include a concave surface 612 configured to curve around a portion of the user index finger, thumb, and/or thumb webbing. In some implementations, the gripping aid 600 may have a uniform width from the first end 608 to the second end 610. However, in other implementations as shown below, the gripping aid may have a width that varies.

Figure 7:
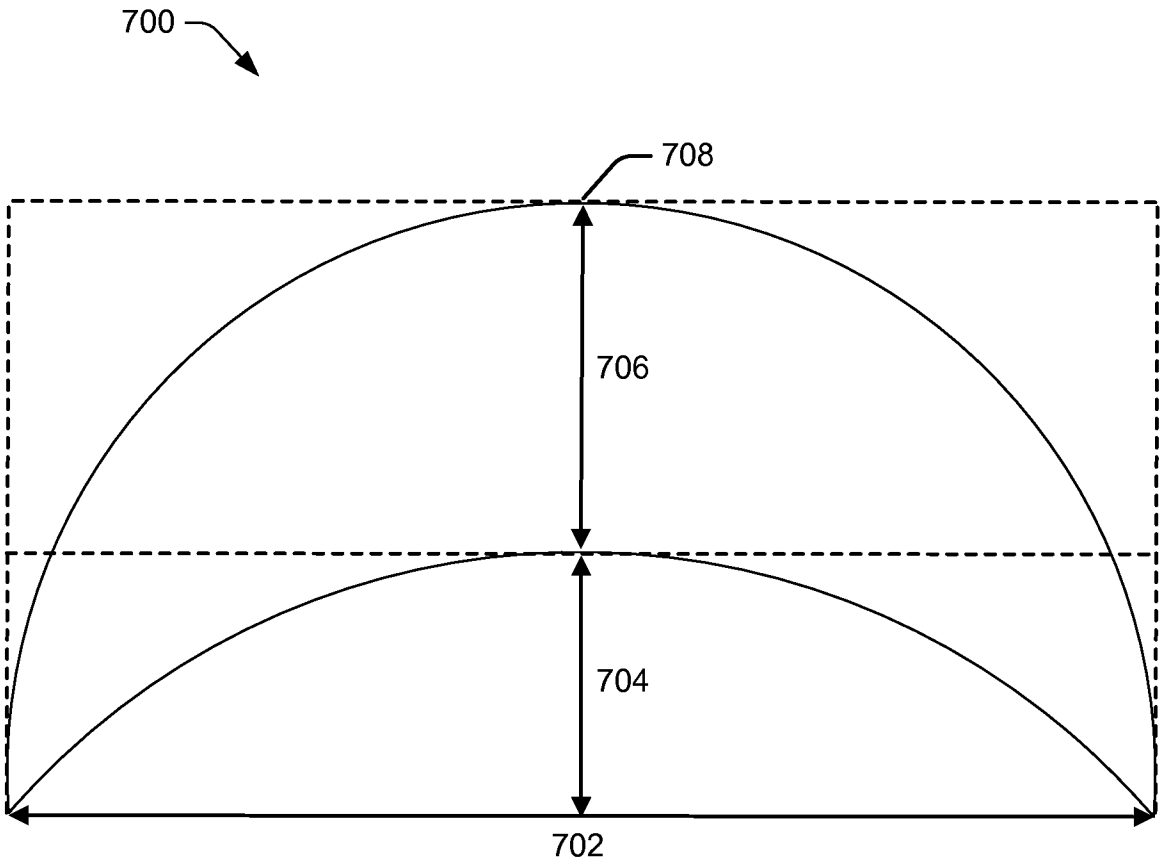
FIG. 7 is a cross-sectional view of the example gripping aid shown in FIG. 6.

FIG. 7 illustrates a cross sectional view of an example gripping aid 700. In this implementation, the gripping aid 700 has a symmetrical shape with a width 702 that is equal distance from a centerline of the gripping aid 700. As shown, the gripping aid 700 may include a concave surface with a depth shown at 704. As described above, the concave surface may allow for the gripping aid 700 to securely conform to the various parts of the user's hand.

FIG. 7 also shows a thickness 706. As shown, the thickness 706 of the gripping aid 700 may be thickest at a point 708. Point 708 may correspond to the apex of the gripping aid 700. As described above, the point 708 may provide the crest, pivot ridge or fulcrum which allows the gripping tool to more rapidly be manipulated as the handle of the tool crests the point 708.

Figure 10:
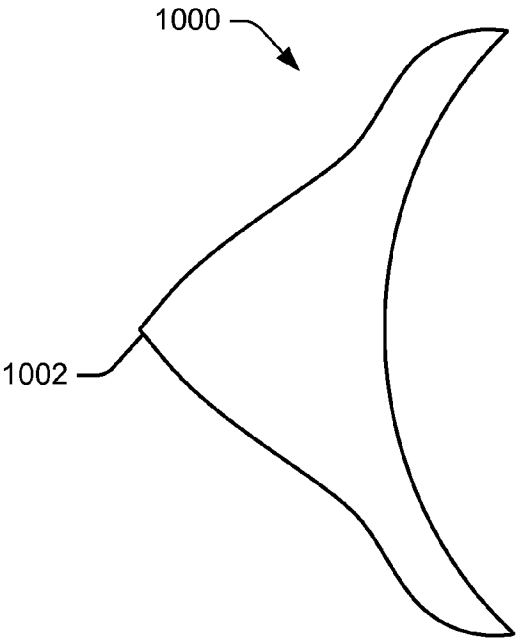
FIGS. 8-10 are cross-sectional or profile views of example gripping aid with different crests.
Figure 9:
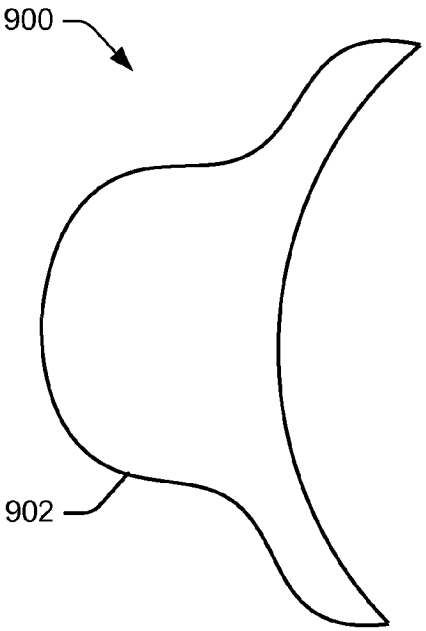
Figure 8:
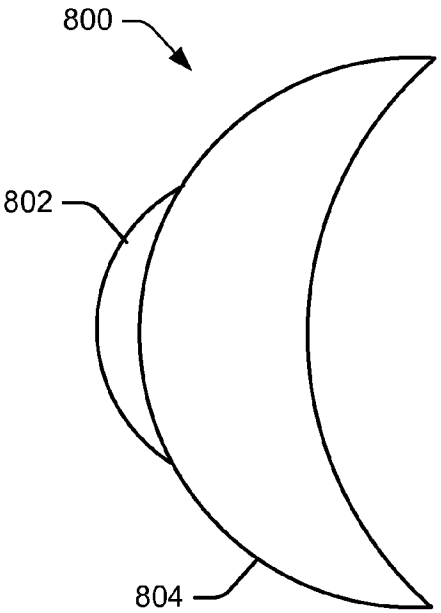

FIGS. 8-10 illustrate alternative example profile shapes of a gripping aid. FIG. 8 shows a profile shape of a gripping aid 800. Gripping aid 800 may be composed of two separate pieces. For instance, a first domed piece 802 to provide the crest as described in the implementation above. In addition, gripping aid 800 may include a second piece 804 which may be positioned between the first piece 802 and a portion of the user's hand. In some implementations, the first piece 802 and the second piece 804 may be composed of the same material. However, in other implementations, each piece may be composed of a different material. For instance, the first piece 802 may be composed of a hard plastic while the second piece may be composed of a softer, flexible, vibration-dampening plastic as described above. In some implementations, the first piece 802 and the second piece 804 may be attached to one another by conventional methods.

FIG. 9 illustrates another example profile shape of an implementation of a gripping aid 900 with an enhanced crest 902. As shown, the crest 902 is more prominently elevated from the body of the gripping aid 900 (at least as compared with the profile of the gripping aid 700 shown in FIG. 7). In some implementations, the more prominent crest 902 may enhance the benefit described above of the crest. For instance, the more prominent crest may increase the speed and/or strength at which the tool is being swung without requiring the user to adjust the swing speed and/or grip of the tool handle.

FIG. 10 illustrates yet another example profile of an implementations of a gripping aid 1000 with a more pointed crest 1002. For similar reasons to those mentioned above with regard to FIG. 9, the pointed crest 1002 may help increase the tool speed as the tool crest the crest 1002. In addition, the pointed crest 1002 may increase the grip span of the user holding the handle of the tool begin swung. In this instance, the increased grip span may increase the grip strength of the user without requiring the user to alter his/her existing grip.

Figure 11B:
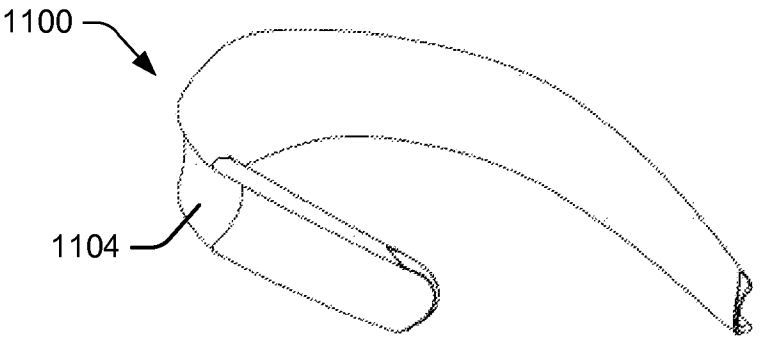
FIGS. 11A-11D are various views of an example gripping aid having a contoured shape and taper with varying widths and thicknesses.
Figure 11D:
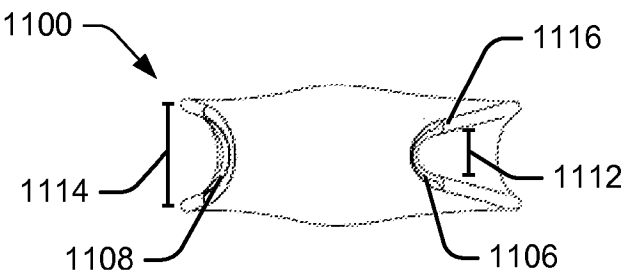
Figure 11A:
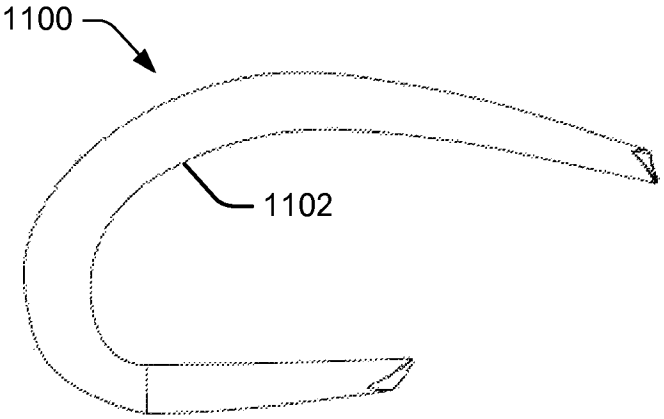

FIGS. 11A-11D illustrate, respectively, a top, a perspective, a left side, and a front view of an example implementation of a gripping aid 1100. FIG. 11A shows the gripping aid 1100 having a pre-molded contour to secure mask the lateral aspect of a user's hand along the thumb webbing between a joint on the index finger and a joint on the thumb. In addition, FIG. 11A shows the crest 1102 formed by the apex or ridge on the side of the gripping aid 1100 configured to interact with the handle of the tool. In some implementations, the crest 1102 runs the entire length of the gripping aid 1100. However, in other implementations, the crest 1102 may be positioned over a portion of the gripping aid 1100. For instance, the crest 1102 may be disposed over a surface opposite the thumb webbing of the user.

FIG. 11B illustrates a perspective view of the gripping aid 1100 while showing the concave surface 1104 of the gripping aid 1100. As described above, the concave surface 1104 may be configured to contour to a surface of the user's hand (e.g., the lateral aspect of the index finger, thumb webbing, and/or thumb). As shown, the width and depth of the concave surface 1104 may vary based on the size of the surface of the user's hand that is to be contoured. In some implementations, the width and depth of the concave surface 1104 may vary based on a corresponding thickness of the gripping aid 1100. For instance, a thicker portion of a gripping aid may correspond to the concave surface 1104 with a greater depth.

Figure 11C:
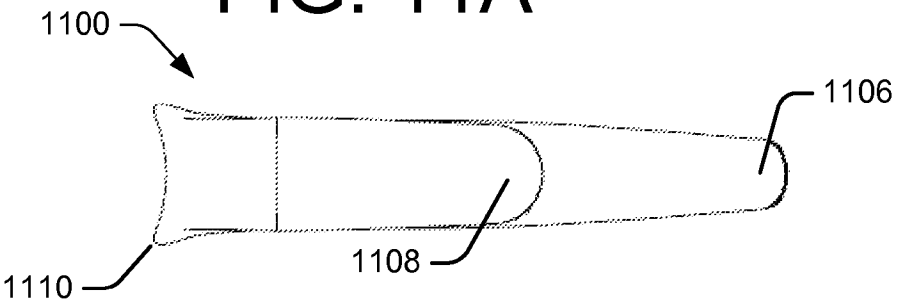

FIG. 11C illustrates the gripping aid 1100 with a variable width. In some implementations, a variable width may increase comfort and/or increase a range of motion of the user's hand as the glove with the gripping aid is squeezed. As shown, the gripping aid 1100 has a first width at the first end 1106. The first end 1106 corresponds to a portion of the gripping aid 1100 configured to interact with the index finger of the user which is generally less wide that the thumb of the user. In this implementation, a second end 1108 may include a second width which is wider than the width at the first end 1106. The second end may be configured to contour a portion of the user's thumb. Further, the gripping aid 1100 may include yet another width such as the third width shown at a thumb portion 1110. As shown, the third width at the thumb portion 1110 may be the widest portion of the gripping aid 1100. In some implementations, the width at the thumb portion 1110 may increase the overall stability of the gripping aid 1100 and provide a better base for the gripping aid 1100 to remain securely in place on the user's hand as the user manipulates a handled tool.

FIG. 11D illustrates a front view of the gripping aid 1100. Generally, the front view shows the variation in the width of the first end 1106 (width 1112) and the second end 1108 (width 1112). FIG. 11D also illustrates a reduction in thickness (i.e., taper 1116) toward the first end 1106 and the second end 1108. In some implementations, the reduction in thickness may increase comfort of the gripping aid 1100. Furthermore, the reduction of thickness at each end may increase the tactile sensation that the user may perceive which may in turn increase an amount of control of the handle that the user perceives. While FIG. 11D illustrates a consistent reduction in thickness at each end 1106 and 1108, respectively, it is understood that each end may taper at a different severity or include no taper at all.

Figure 12:
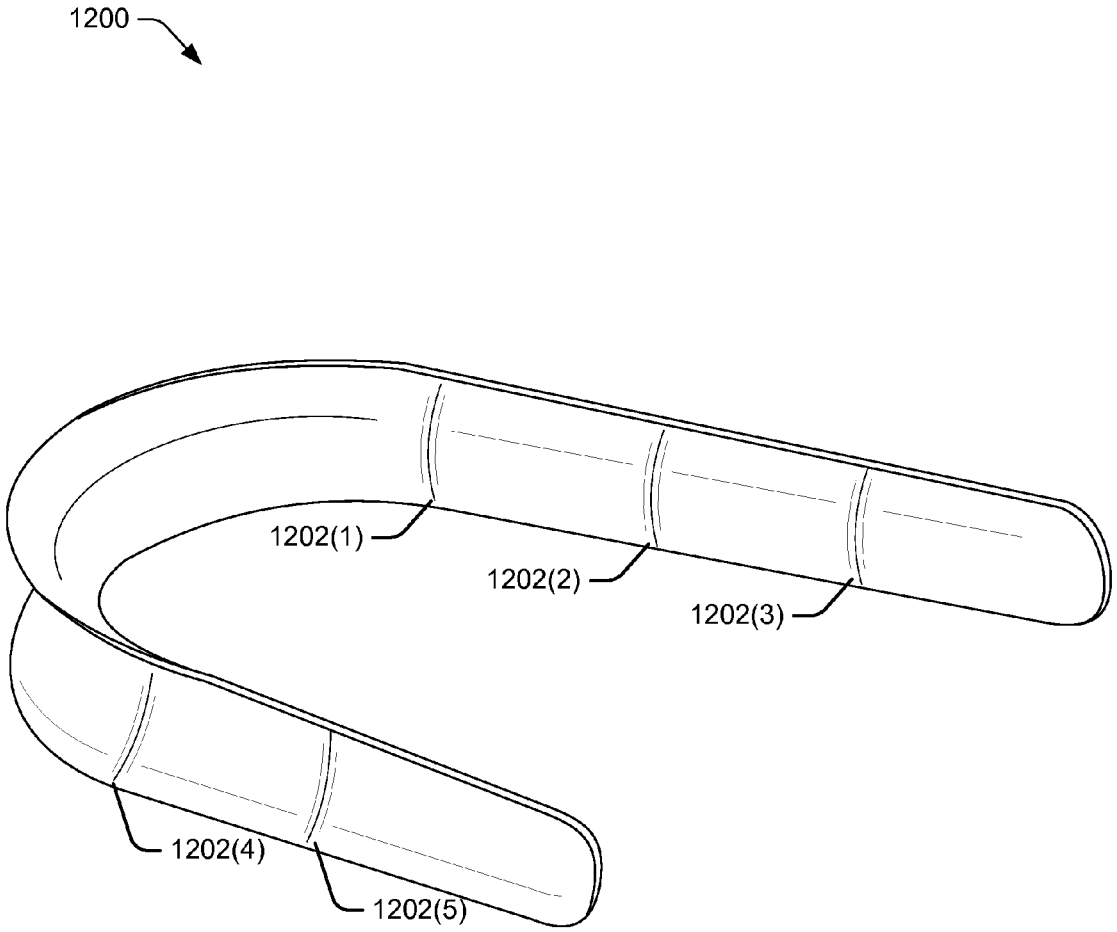
FIG. 12 is a perspective view of another example gripping aid having hinges.

FIG. 12 illustrates an example gripping aid 1200 with multiple hinges 1202(1)-(5). In some implementations, the gripping aid 1200 may include the hinges 1202(1)-(5) to facilitate the flexible elastomeric plastic in bending. As shown, the hinges 1202(1)-(5) may be located on the portions of the gripping aid 1200 opposite the index finger and/or thumb. The hinges 1202(1)-(5) may be living hinges such as scored seams in the gripping aid 1202 that when the gripping aid is bend, the seams provide a bend point on the gripping aid 1200. While FIG. 12 illustrates five hinges, it is understood that more or fewer hinges may be used in other implementations. For example, one hinge or ten hinges. Furthermore, in other implementation, any number of other hinges may be used in place of or in combination with the scored seams described above. For instance, the hinges may be a parametric kerf pattern, a partially scored seam, a living hinge, a lattice hinge, a zipper joint, and/or a rib joint.

Figure 13:
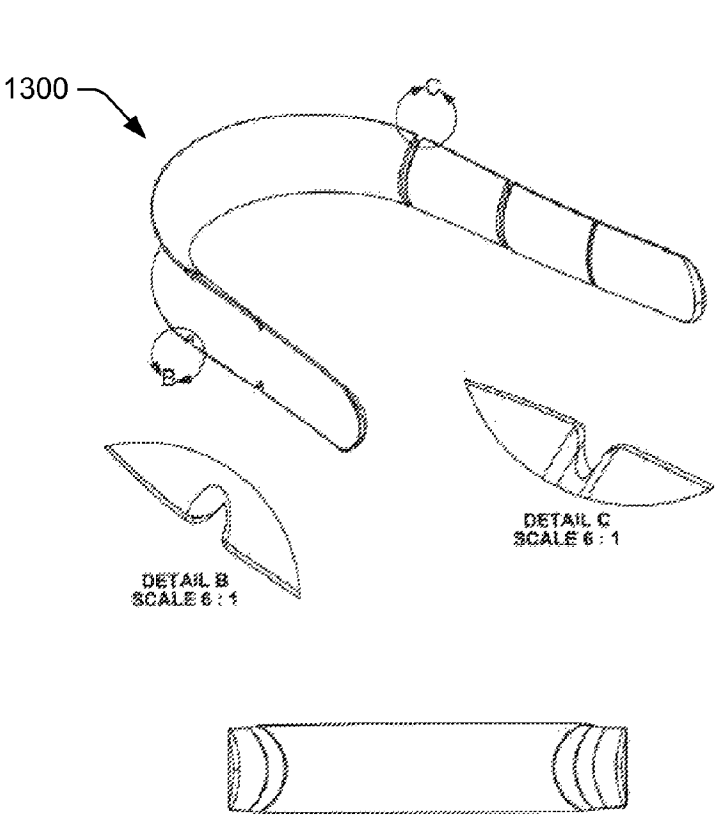
FIG. 13 include various views of yet another example gripping aid having a uniform width and hinge notches.
Figure 13:
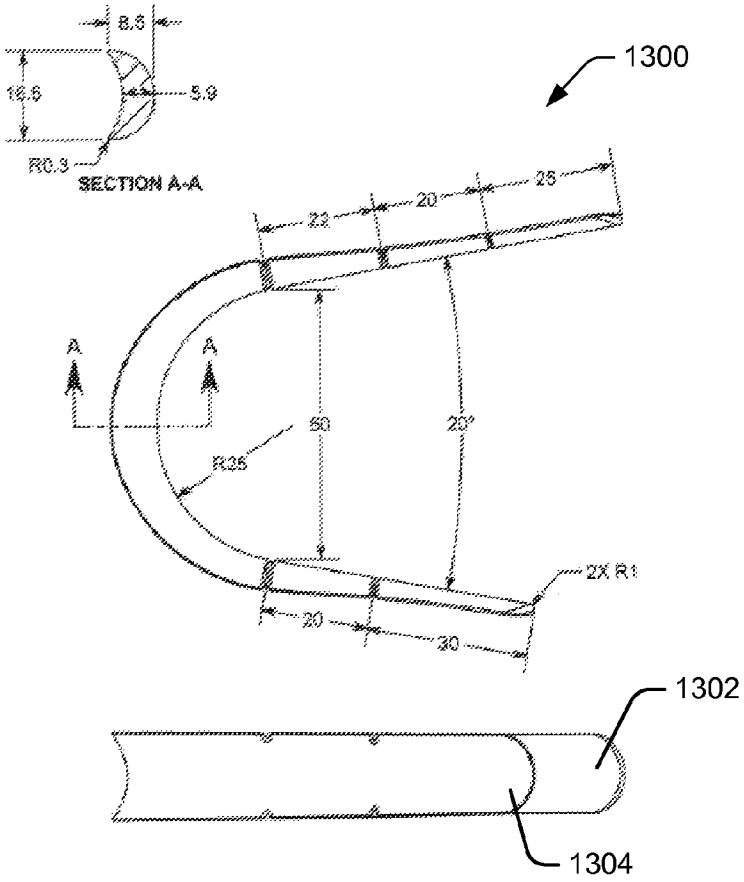

FIG. 13 illustrates various views of an example gripping aid 1300 which may be used with a glove to provide the benefits described above. As shown, the gripping aid 1300 has a uniform width from a first end 1302 to a second end 1304. Furthermore, the views of FIG. 13 illustrate various example dimensions of the gripping aid 1300. For instance, the gripping aid shown the index finger portion having three areas separated by a score line. Each portion having a different length. For instance, the end portion having a length of 25 millimeters, the middle portion having a length of 20 millimeters, and the inner portion having a length of 22 millimeters.

Gripping aid 1300 may also include one or more hinges as described above. However, as shown in FIG. 13, gripping aid 1300 may include a score line on the inner surface of the aid while the top surface and bottom surface may include a notch at the score line. The score line and corresponding notch may improve the flexibility of the gripping aid in the designated locations. Furthermore, such a hinge may restrict unwanted flexibility of the gripping aid in the opposite direction. Finally, the hinge may allow the gripping aid to withstand a greater amount of torque without tearing or otherwise breaking.

In some implementations, the lines on the gripping aid 1300 may be formed to be gaps in the gripping aid. The gaps may be configured to be located over the joints of the user's digits. In other implementations, the gaps may be configured to be a specific width such that it coordinates with a specific location of a user's index finger. For instance, the gap may be located along the gripping aid such that a portion of the gripped tool fits within the gap.

Figure 14:
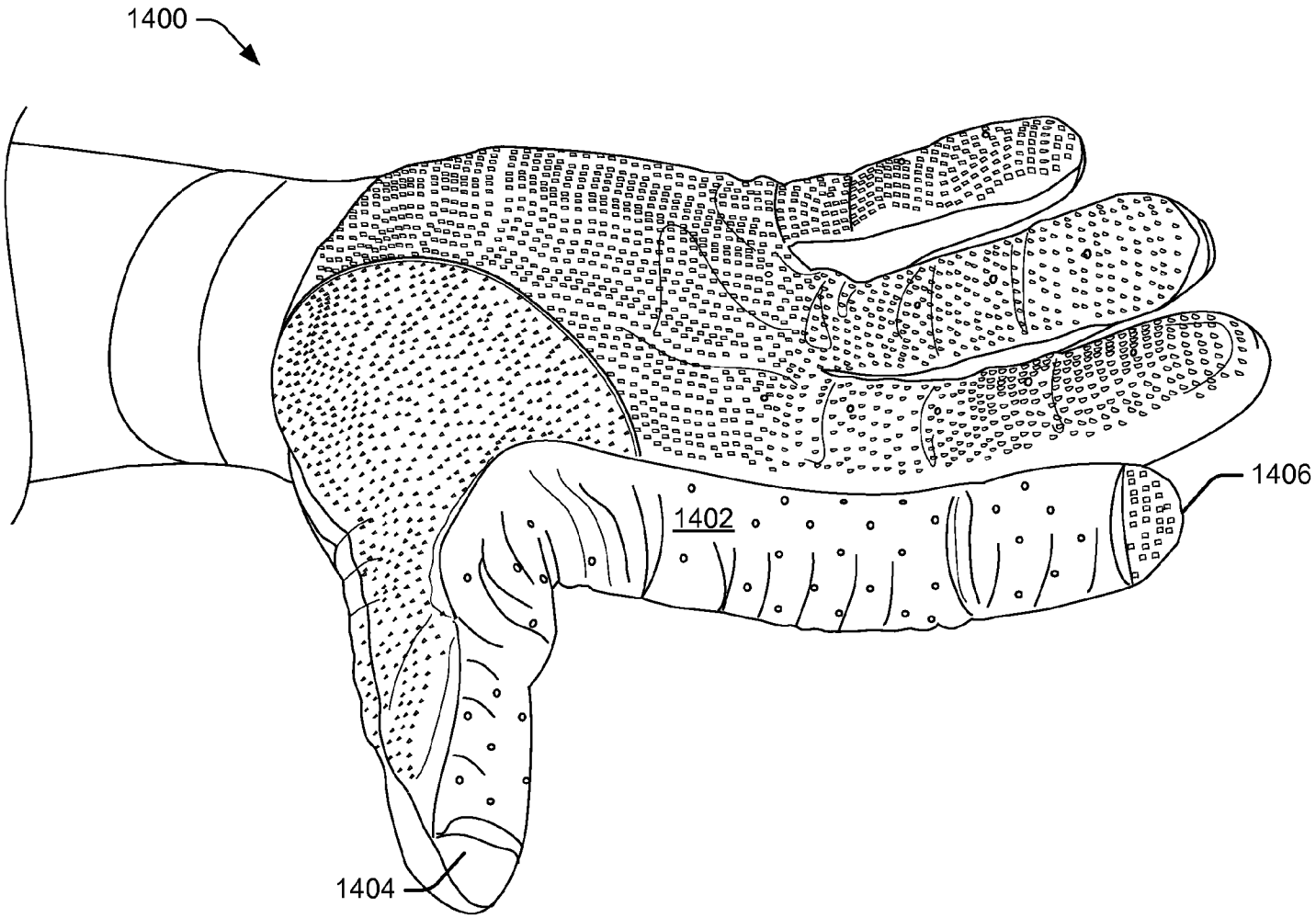
FIG. 14 is another example glove with a gripping aid that runs from the tip of the first digit to a tip of a second digit.

FIG. 14 illustrates another implementation of a gripping glove 1400. As shown, the glove 1400 includes a gripping aid 1402 which may be an implementation of a gripping aid describe above. For instance, gripping aid may include any thickness or width depending on user's comfort and/or the task the user desires to perform while wearing glove 1400. In this implementation, gripping aid 1402 may be integrated with glove 1400 starting at a tip (or from about ½ inch from the tip) of a first digit 1404 (i.e., thumb) and travel along the thumb webbing to end at a tip (or from about ½ inch from the tip) of a second digit 1406 (i.e., index finger).

The gripping aid 1402 may be composed of crush resistant material and include a crest to provide the benefits of the glove and gripping aid as described above. In some implementation, the gripping aid 1402 may include a taper on both ends of the gripping aid 1402 as the gripping aid 1402 approaches each of the tip of first digit 1404 and the second digit 1406. In some implementations, the taper at both ends may be substantially the same. However, in other implementation, the taper at each end may be different from one another, FIG. 14 also illustrate that the gripping aid may be integrated with glove 1400 without the external stitching as shown in the implementations above. In this implementation, the gripping aid 104 may be inserted on the interior portion of the glove 1400.

Example Process

Figure 15:
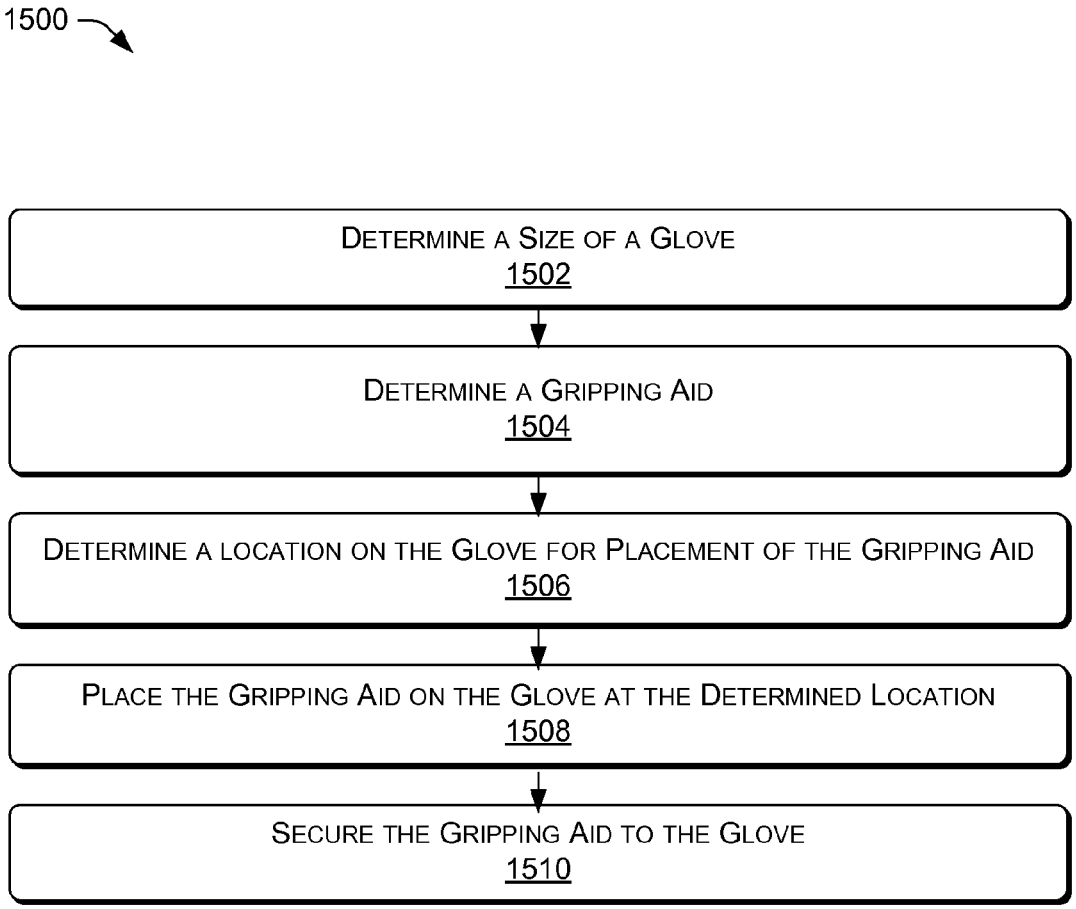
FIG. 15 is an example process for assembling the gripping glove with a gripping aid.

FIG. 15 illustrates an example process 1500 for assembling an example gripping glove as described above. The process 1500 is illustrated as a logical flow graph. The order in which the operations or steps are described is not intended to be construed as a limitation, and any number of the described operations can be combined in any order and/or in parallel to implement the process 1500.

The process 1500 for assembling a gripping glove begins at 1502 where a size of a glove may be determined. As described above, the gripping glove may be constructed in numerous sizes to fit various sizes of a human hand (e.g., extra-small, small, medium, large, and extra-large, etc).

At 1504, a gripping aid may be determined. In some implementations, the determination of the gripping aid may be based on the determined size of the glove. In some implementations, the determining the gripping aid may further comprise determining the size and/or shape (e.g., thickness, taper, crest profile, width, and/or material) of the gripping aid.

At 1506, a location for placement of the gripping aid on the determined glove may be determined. In some implementations, the location may correspond to the lateral aspect on the glove running from a joint on the index finger through the thumb webbing and ending at a joint on the thumb. Furthermore, the location may be an exterior portion of the glove. In other implementations, the location may be determined to be an inner portion of the glove when the gripping aid is directly in contact with the glove wearer's skin.

At 1508, the gripping aid may be placed on the determined glove at the determined location. Finally, at 1510, the gripping aid may be secured or attached to the glove. For instance, the gripping aid may be secured by one or more pieces of fabric attached (e.g., sewn, adhered, etc. . . . ) over the gripping aid. In other implementations, the gripping aid may be secured (e.g., sewn, glued, adhered, sonic welded, etc. . . . ) directly to the exterior or interior determined location on the glove.

CONCLUSION

Although the disclosure describes embodiments having specific structural features and/or methodological acts, it is to be understood that the claims are not necessarily limited to the specific features or acts described. Rather, the specific features and acts are merely illustrative some embodiments that fall within the scope of the claims of the disclosure.

What is claimed is:

1. A glove for a human hand comprising:

a gripping support secured to the glove that continuously span a location of the human hand from a portion of a thumb of the human hand to a portion of an index finger of the human hand, the gripping support having:

a crest substantially spanning a length on an exterior surface of the gripping support, the crest facing away from a palmar side of the location of the human hand and providing a pivot point for a tool manipulated by the human hand.

2. The glove as recited in claim 1, wherein the gripping support increases a grip span of the human hand by filling at least one gap between the tool held in the human hand and the location of the human hand.

3. The glove as recited in claim 1, wherein the gripping support is offset toward a lateral surface of the human hand to allow flexibility of along the location of the human hand and to reduce impingement along the location of the human hand when a squeezing force is applied to the gripping support.

4. The glove as recited in claim 1, wherein the pivot point is configured to speed the centripetal force of a distal end of the tool as the human hand manipulates a proximal end of the tool.

5. The glove as recited in claim 1, wherein the gripping support comprises a compression resistant, vibration dampening, flexible material such as silicone rubber, ethylene propylene rubber, or other elastomers.

6. The glove as recited in claim 1, wherein the gripping support is pre-formed to fit the location of the human hand from a metacarpophalangeal (MCP) joint of the thumb of the human hand to a MCP joint of the index finger of the human hand and wherein an interior surface of the gripping support facing toward the human hand includes a concave surface to contour to the location of the human hand.

7. The glove as recited in claim 1, wherein the portion of the thumb is an interphalangeal (IP) joint of the thumb and the portion of the index finger is a proximal interphalangeal (PIP) joint of the index finger.

8. The glove as recited in claim 1, wherein the portion of the thumb is substantially the tip of the thumb and the portion of the index finger is substantially the tip of the index finger.

9. The glove as recited in claim 1, wherein the gripping support comprises one of:

a single portion of material, wherein the single portion includes one or more hinges, each of the one or more hinges configured to provide a location for bending of the gripping support; or multiple portions of material that adjoin to continuously span the location of the human hand, wherein one or more gaps between each of the multiple portions provides multiple locations of bending of the gripping support.

10. A method of assembling a glove comprising:

determining characteristics of a gripping support, the gripping support including at least a contoured surface representing a pivot point, the contoured surface positioned to face away from a human hand wearing the glove; and determining a location on the glove for placement of the gripping support, the location continuously spanning from a portion of a thumb of the human hand to a portion of an index finger of the human hand;

placing the gripping support on the glove at the determined location; and securing the gripping support to the glove.

11. The method as recited in claim 10, further comprising:

determining a size of the glove; and wherein the characteristics of the gripping support are determined based at least in part on at least one of the determined size of the glove or an intended use of the glove.

12. The method as recited in claim 10, wherein the characteristics of the gripping support comprise at least one of:

a shape of the gripping support;

a thickness of the gripping support;

a width of the gripping support;

one or more materials of the gripping support;

a taper of one or more ends of the gripping support; or the contour surface of the gripping support.

13. The method as recited in claim 10, wherein the location on the glove for placement of the gripping support is on an exterior portion of the glove or an interior portion of the glove.

14. The method as recited in claim 10, securing the gripping support to the glove comprises at least one of:

attaching one or more pieces of fabric over the gripping support; or adhering the gripping support directly to the glove.

15. A flexible gripping support comprising:

a first portion disposed on a portion of an index finger of a human hand;

a second portion disposed on a portion of a thumb of the human hand; and a third portion disposed over a thumb webbing between the portion of the index finger and the portion of the thumb, wherein the gripping support is formed of a continuous piece of a compression resistant material spanning between the portion of the index finger to the portion of the thumb and has a crest at least spanning the third portion.

16. The gripping support as recited in claim 15, wherein the gripping support is configured to substantially flex at least along an axis parallel to the index finger and the thumb such that the domed crest contacts a portion of a handle of a tool as the human hand grips the tool.

17. The gripping support as recited in claim 15, wherein at least the third portion has a thickness from about 1 millimeter to about 25.5 millimeters.

18. The gripping support as recited in claim 15, wherein the compression resistant material resists deformation to allow the gripping support to fill at least one gap between a handle of a tool held in the human hand and the thumb webbing.

19. The gripping support as recited in claim 15, wherein the first portion and the second portion comprise at least one of:

a parametric kerf pattern;
a partially scored seam;
a living hinge;
a lattice hinge;
a zipper joint; or
a rib joint.

20. The gripping support as recited in claim 15, wherein a thickness of the first portion and a thickness of the second portion gradually reduce as each extends away from the third portion.

* * * * *